US009570228B1

(12) United States Patent
An

(10) Patent No.: US 9,570,228 B1
(45) Date of Patent: Feb. 14, 2017

(54) TRANSFOMER STRUCTURE

(71) Applicant: Chicony Power Technology Co., Ltd., New Taipei (TW)

(72) Inventor: Ka-Hung An, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/832,124

(22) Filed: Aug. 21, 2015

(51) Int. Cl.
*H01F 27/30* (2006.01)
*H01F 27/32* (2006.01)

(52) U.S. Cl.
CPC ..... *H01F 27/325* (2013.01)

(58) Field of Classification Search
CPC ..... H01F 27/32; H01F 27/28; H01F 27/2823; H01F 27/2847; H01F 27/2866; H01F 27/323–27/325; H01F 5/02; H01F 2005/027
USPC ..... 336/198, 208, 196
See application file for complete search history.

(56) References Cited

U.S. PATENT DOCUMENTS

2007/0057757 A1* 3/2007 Chen ..... H01F 27/2866 336/212
2014/0062642 A1* 3/2014 Lin ..... H01F 27/2847 336/196
2016/0133379 A1* 5/2016 Lin ..... H01F 27/325 336/198

FOREIGN PATENT DOCUMENTS

CN 101567250 A 10/2006
CN 201508752 U 6/2010
CN 103426614 A 12/2013
CN 103680866 A 3/2014
CN 103985527 A 8/2014
CN 104766706 A 7/2015
JP 2014192498 A 10/2014
TW M491930 U 12/2014

OTHER PUBLICATIONS

Technical Evaluation Report Dated Nov. 27, 2015 of the Corresponding China Utility Model Patent No. ZL2015205330154.

* cited by examiner

*Primary Examiner* — Mangtin Lian
(74) *Attorney, Agent, or Firm* — Chun-Ming Shih; HDLS IPR Services

(57) ABSTRACT

A transformer structure includes a winding cylinder which is a hollow tube, at least one limiting ring which is a ring sheet, multiple conductive sheets and at least one winding. The limiting ring is able to slide along the winding cylinder and to sleeve on the outside of the winding cylinder. The conductive sheets are sleeved on the outside of the winding cylinder. Two conductive sheets of the conductive sheets are attached to two end surfaces of the limiting ring while the two conductive sheets and the limiting ring form a winding space. The at least one winding is correspondingly disposed in the winding space. Thereby, the assembly of the transformer is simplified, and the winding area, as well as the voltage ratio of the transformer, is increased.

11 Claims, 6 Drawing Sheets

TRANSFOMER STRUCTURE

TECHNICAL FIELD

The disclosure relates to a transformer, more particularly to a winding structure of a transformer.

BACKGROUND

A transformer performs voltage conversion by utilizing the principle of electromagnetic induction. It mainly comprises a winding axis, an iron core, the first and second windings wound around the winding stand, etc. An input voltage is transmitted to the first winding before the iron core generates electromagnetic effects, and this makes the second winding generate output voltage. Since the numbers of turns of the first and second windings are different, a different output voltage can be obtained.

The traditional transformer has multiple double flange bobbins which have a winding groove. The copper wire is wound around the winding groove to form the first winding. Additionally, traditional transformers use the conductive sheet as the second winding. The conductive sheet is disposed between the adjacent double flange bobbins (outside the winding groove). That is, double flange bobbins of the traditional transformer are between the first winding and the second winding. Since the double flange bobbin is with certain thickness, it takes up the winding space on the winding axis, which affects the output voltage of the transformer. Furthermore, the assembly processes of the traditional transformer are complicated.

Hence, the disclosure provides an improved design to solve the aforementioned problems.

SUMMARY

One purpose of the disclosure is to provide a transformer structure with simplified assembly processes and with increased winding area and voltage ratio of the transformer.

To reach this goal, the disclosure provides a transformer structure comprising a winding cylinder which is a hollow tube, at least one limiting ring which is a ring sheet, a plurality of conductive sheets and at least one winding. The limiting ring is able to slide along the winding cylinder and to sleeve on the outside of the winding cylinder. The conductive sheets are sleeved on the outside of the winding cylinder. Two conductive sheets of the conductive sheets are attached to two end surfaces of the limiting ring while the two conductive sheets and the limiting ring form a winding space. The at least one winding is correspondingly disposed in the winding space.

Another purpose of the disclosure is to provide a transformer structure in which the limiting ring limits the movement of the conductive sheet which is therefore sandwiched and outside of the winding cylinder. This improves the quality of the winding and reduces the leakage inductance difference.

Still another purpose of the disclosure is to provide a transformer structure without utilizing the double flange bobbins (separation plates). The conductive sheet, therefore, contacts air directly so the effect of heat dissipation is better.

The other purpose of the disclosure is to provide a transformer structure in which the width of the winding is roughly equal to the width of the limiting ring. Hence, the required width of the winding may be obtained by amending the width of the limiting ring. This makes the structure of the disclosure more versatile.

Compared to prior art, the limiting ring of the transformer component of the disclosure is sleeved on the outside of the winding cylinder and the two conductive sheets are respectively attached to two end surfaces of the limiting ring. This puts the winding in the winding space correspondingly, thereby simplifying the assembly of the transformer. Moreover, the conventional transformer disposes the winding on the winding groove of the double flange bobbins but the limiting ring of the disclosure eliminates two lateral widths of the double flange bobbins and eliminates the usage of the insulation tape. This significantly increases the winding area and therefore the output voltage ratio of the transformer. Additionally, the conductive sheet of the disclosure is firmly sandwiched on the outside of the winding cylinder and contact air directly, thereby improving the heat dissipation effect.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
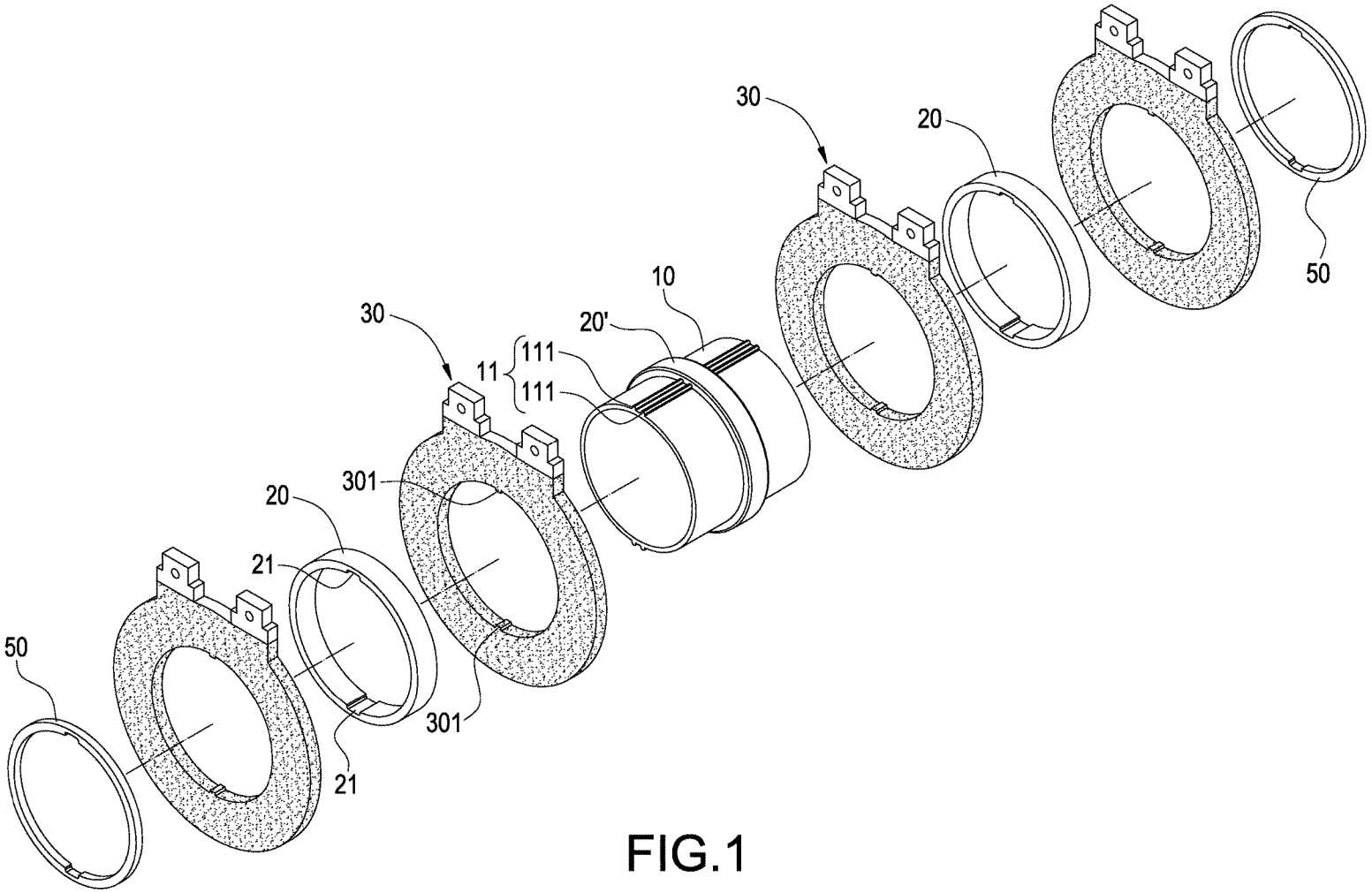
FIG. 1 is an exploded view of a winding structure of a transformer of the disclosure.
Figure 2:
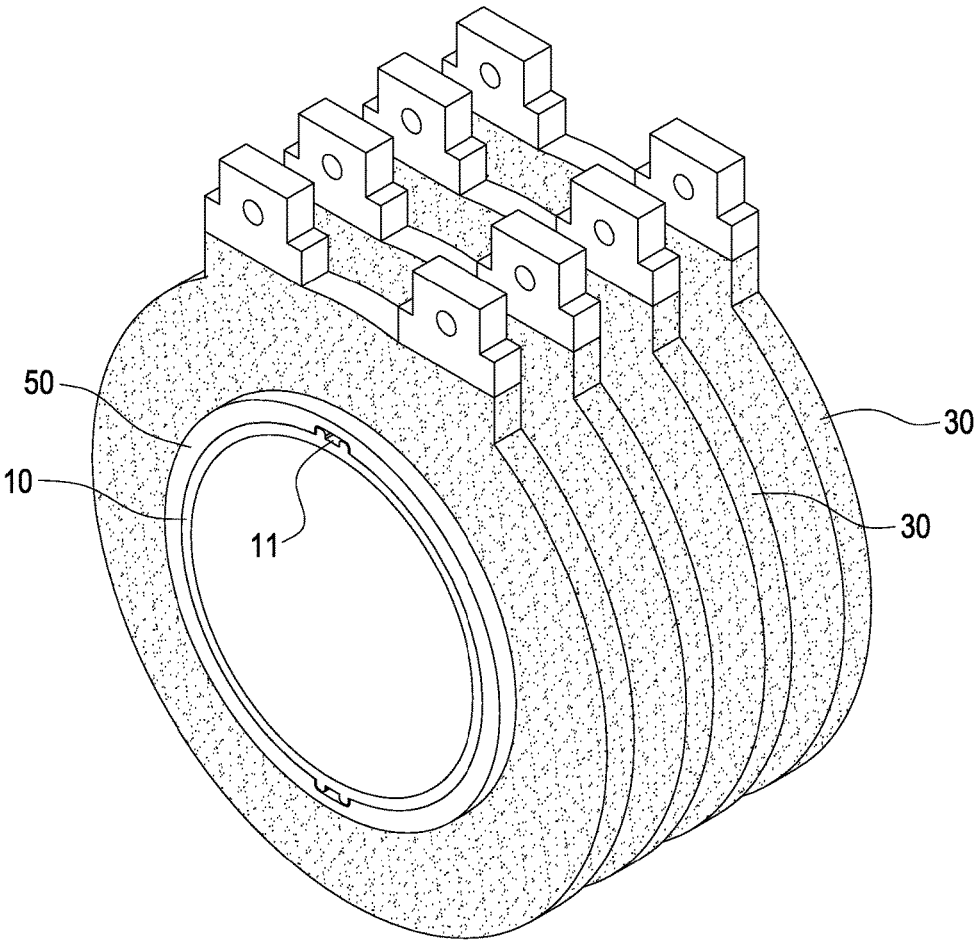
FIG. 2 is a perspective view of the winding structure of the transformer of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 to FIG. 4 are an exploded view, a perspective view, a sectional on one side and a sectional view on another side of the winding structure of the transformer of the disclosure, respectively. The transformer structure of the disclosure comprises a winding cylinder 10, at least one limiting ring 20, a plurality of conductive sheets 30, at least one winding 40 and a plurality of locating rings 50. The limiting ring 20, the conductive sheets 30 and the locating rings 50 are sleeved on the winding cylinder 10. The winding 40 is disposed on the limiting ring 20. The detailed structure is illustrated hereinafter.

The winding cylinder 10 is a hollow tube. The limiting ring 20 is a ring sheet. The limiting ring 20 is capable of sliding along the winding cylinder 10 and is sleeved on the outside of the winding cylinder 10. In one embodiment of the disclosure, the surface of the winding cylinder 10 has at least one sliding rail 11 formed by two ribs 111. Additionally, the inner surface of the limiting ring 20 disposes with a sliding groove 21 corresponding to the sliding rail 11. The limiting ring 20 slides along the sliding rail 11 via the sliding groove 21 and is therefore sleeved on the outside of the winding cylinder 10.

In this embodiment, the number of the limiting rings 20 is plural while the limiting ring 20' in the middle and the winding cylinder 10 are integrally formed. However, the disclosure is not limited thereto.

The conductive sheets 30 are sleeved on the outside of the winding cylinder 10 and two of them are attached to two end surfaces of the limiting ring 20 respectively. These two conductive sheets 30 and the limiting ring 20 form a winding space 200. In this embodiment, the winding structure of the transformer comprises three limiting rings 20 and four conductive sheets 30, but in practice the disclosure is not limited thereto.

In this embodiment, each conductive sheet 30 comprises a copper sheet 31, an insulation film 32 covering the copper sheet 31 and a connecting pin 33 extending from the copper sheet 31 and exposed by the insulation film 32. Furthermore, the insulation film 32 is attached to the winding 40. Also, each conductive sheet 30 disposes with a block 301 corresponding to the sliding rail 11 of the winding cylinder 10. The block 301 slides between and leans against the two ribs 111.

Moreover, the locating rings 50 are sleeved on the outside of the outermost two conductive sheets 30. Preferably, the winding cylinder 10, the limiting ring 20 and the locating ring 50 are made of polyethylene terephthalate (abbreviated as PET or PETE).

Figure 3:
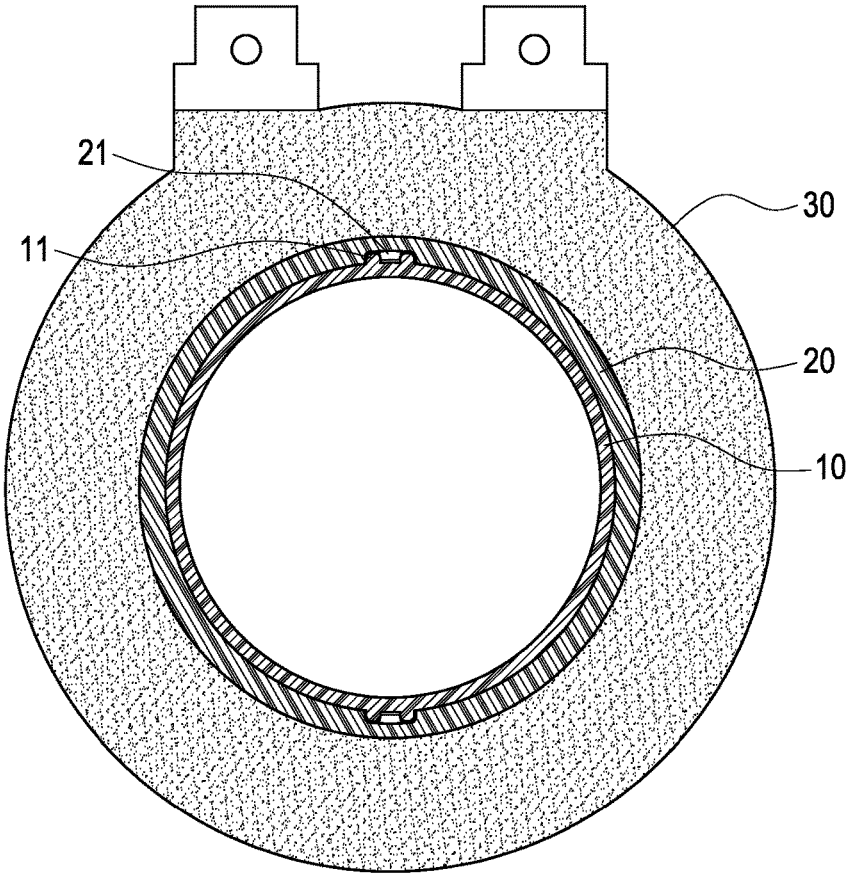
FIG. 3 is a sectional view on one side of the winding structure of the transformer of the disclosure.
Figure 4:
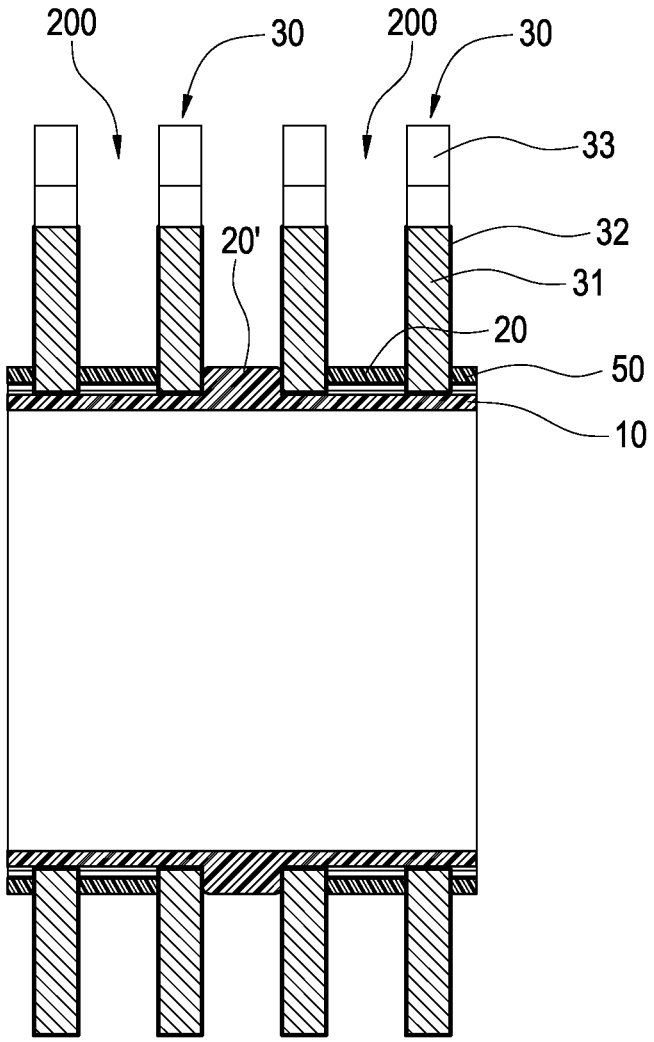
FIG. 4 is a sectional view on another side of the winding structure of the transformer of the disclosure.

As seen in FIG. 3, when the limiting ring 20 slides along the sliding rail 11 (formed by two ribs 111) of the winding cylinder 10 via the sliding groove 21 and is therefore sleeved on the winding cylinder 10, the inner surface of the sliding groove 21 is attached to and leans against the outside of the two ribs 111. Besides, in this embodiment, two surfaces on the opposite sides of each winding cylinder respectively have a sliding rail 11. The inner surfaces of the limiting ring 20 respectively dispose with a sliding groove 21 corresponding to the sliding rail 11. Thereby, the limiting ring 20 slides along the extending direction of the sliding rail 11 relative to the winding cylinder 10, without rotating.

In one embodiment of the disclosure, the surface area of the winding cylinder 10 outside the sliding rail 11 is a smooth surface; also, the inner surface area of the inner surface of the limiting ring 20 outside the sliding groove 21 is set as a smooth surface correspondingly, thereby being attached to each other.

Figure 5:
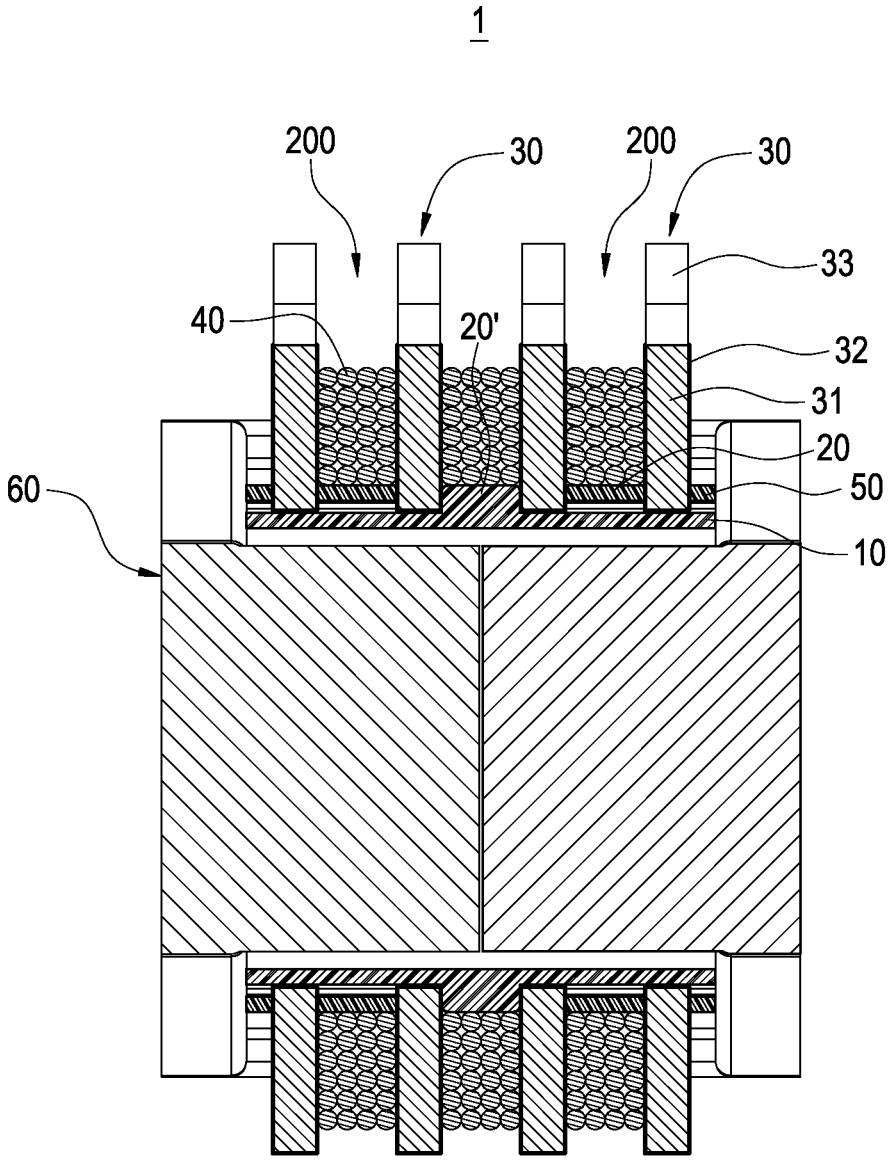
FIG. 5 is a sectional view of the transformer structure of the disclosure.

FIG. 5 is a sectional view of the transformer structure of the disclosure. As seen in FIG. 5, the winding 40 is made by multiple copper wires wound together and is disposed in the winding space 200 correspondingly. Additionally, the transformer structure 1 of the disclosure further comprises an iron core 60 going through the winding cylinder 10 and leaning against the locating rings 50. Thereby, the limiting ring 20, the conductive sheets 30, the winding 40 and the locating rings 50 are positioned on the winding cylinder 10.

It is noted that the width of the winding 40 is roughly equal to the width of the limiting ring 20. Hence, the required width of the winding 40 may be obtained by amending the width of the limiting ring 20. This makes the structure of the disclosure more versatile.

Figure 6:
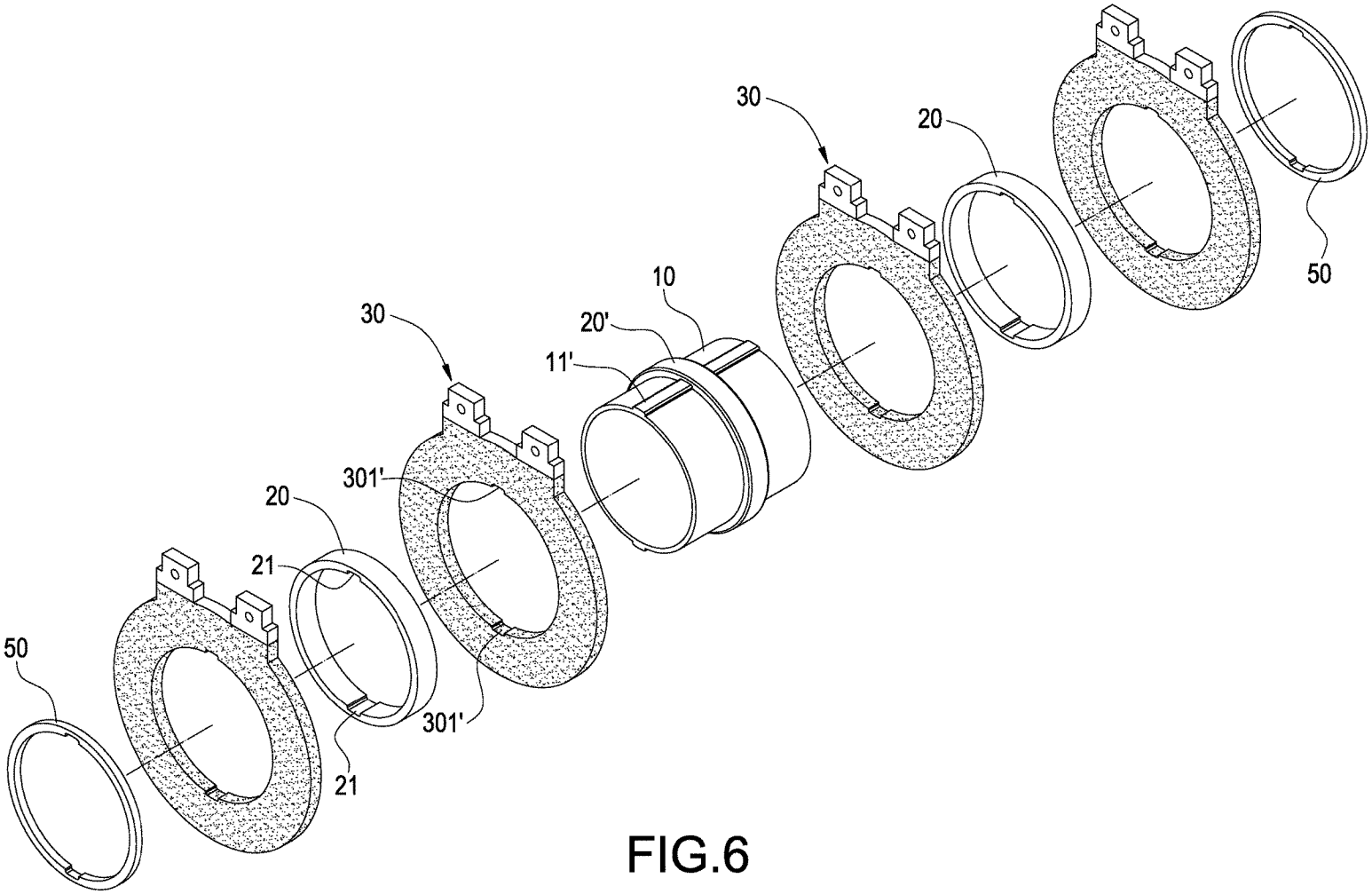
FIG. 6 is another embodiment of the assembly of the transformer structure of the disclosure.

FIG. 6 is another embodiment of the assembly of the transformer structure of the disclosure. Referring to FIG. 6, this embodiment is similar to previous embodiment. The transformer structure of the disclosure comprises a winding cylinder 10, at least one limiting ring 20, a plurality of conductive sheets 30, at least one winding 40 and a plurality of locating rings 50. The limiting ring 20, the conductive sheets 30 and the locating rings 50 are sleeved on the winding cylinder 10. The winding 40 is disposed on the limiting ring 20. However, the positioning method between the limiting ring 20, the conductive sheets 30 and the winding cylinder 10 is different.

In this embodiment, the surface of the winding cylinder 10 has at least one sliding rail 11' disposed as a single rib. Further, the inner surface of the limiting ring 20 disposes with a sliding groove 21 corresponding to the sliding rail 11'. Moreover, each conductive sheet 30 is disposed as a groove 301' corresponding to the sliding rail 11' of the winding cylinder 10. The sliding rail 11' slides along and leans against the groove 301'.

What is claimed is:

1. A transformer structure, comprising:

a winding cylinder which is a hollow tube;

at least one limiting ring, which is a ring sheet and able to slide along the winding cylinder and to sleeve on the outside of the winding cylinder;

a plurality of conductive sheets sleeved on the outside of the winding cylinder, wherein two of the conductive sheets adjacent to each other are attached to two end surfaces of the at least one limiting ring sandwiched therebetween respectively while the two of the conductive sheets and an outer surface of the at least one limiting ring sandwiched therebetween form a winding space; and at least one winding correspondingly disposed in the winding space and being directly in contact with the two of the conductive sheets and the outer surface of the at least one limiting ring sandwiched therebetween.

2. The transformer structure according to claim 1, wherein a surface of the winding cylinder has at least one sliding rail, an inner surface of the limiting ring disposes with a sliding groove corresponding to the sliding rail, and the limiting ring is sleeved on the outside of the winding cylinder by the sliding groove sliding along the sliding rail.

3. The transformer structure according to claim 2, wherein two surfaces on the opposite sides of the winding cylinder respectively have a sliding rail, the corresponding inner surfaces of the limiting ring respectively dispose with a sliding groove.

4. The transformer structure according to claim 2, wherein the sliding rail is formed by two ribs and the inner surface of the sliding groove leans against the outside of the two ribs.

5. The transformer structure according to claim 4, wherein each conductive sheet disposes with a block corresponding to the sliding rail, and the block is sliding between and leaning against the two ribs.

6. The transformer structure according to claim 2, wherein the sliding rail is a single rib, each conductive sheet disposes with a groove, and the sliding rail slides along and leans against the groove.

7. The transformer structure according to claim 2, wherein the surface area of the winding cylinder outside the sliding rail is a smooth surface while the inner surface area of the inner surface of the limiting ring outside the sliding groove is set as a smooth surface correspondingly, thereby being attached to each other.

8. The transformer structure according to claim 1, wherein the number of the limiting rings is plural, one of the limiting rings and the winding cylinder are integrally formed.

9. The transformer structure according to claim 1, wherein each conductive sheet comprises a copper sheet, an insulation film covering the copper sheet and a conducting pin extending from the copper sheet and is exposed by the insulation film, and the insulation film is attached to the winding.

10. The transformer structure according to claim 1, further comprising a plurality of locating rings which sleeve on the outside of the outermost two conductive sheets.

11. The transformer structure according to claim 1, further comprising an iron core going through the winding cylinder.

* * * * *